United States Patent [19]

Chrones

[11] 4,070,078

[45] Jan. 24, 1978

[54] SAFETY COVER FOR AN ELECTRICAL OUTLET

[75] Inventor: Anthony Chrones, Warwick, R.I.

[73] Assignee: Reliance Products Corporation, Woonsocket, R. I. 02895

[21] Appl. No.: 773,643

[22] Filed: Mar. 2, 1977

[51] Int. Cl.[2] ..... H01R 13/44

[52] U.S. Cl. ..... 339/44 R

[58] Field of Search ..... 339/36, 38, 39, 44 R, 339/44 M, 75 P; 174/66, 67

[56] References Cited

U.S. PATENT DOCUMENTS

| | | | |
|---|---|---|---|
| 2,526,606 | 10/1950 | Gregg | 174/67 |
| 2,870,933 | 1/1959 | Winter | 339/44 R |
| 2,880,264 | 3/1959 | Ruskin | 339/44 R |
| 3,656,083 | 4/1972 | Brook | 339/39 |
| 3,716,815 | 2/1973 | Riches | 339/44 M |

*Primary Examiner*—Roy Lake
*Assistant Examiner*—Neil Abrams
*Attorney, Agent, or Firm*—Cullen, Settle, Sloman & Cantor

[57] ABSTRACT

The safety cover encloses an electric outlet to keep such outlet and the electrical plugs inserted therein out of reach of babies, infants and children of tender years to prevent injuries. It includes a plate mounted over the electrical outlet to expose the sockets and which has a pair of spaced apart latching elements. A pair of hollow closure elements are hingedly connected to the plate and are provided with spaced apart flexible abutments engageable with the latching elements for securing the closure elements against different areas of the plate to thereby enclose the sockets and electrical plugs. Babies and small children are not strong enough to release the closure elements and are thus prevented from touching the outlet and plugs. However, adults and grown children have sufficient strength and know-how and can remove the closure elements for the latched position by applying a force thereto which release the flexible abutments from the latching elements.

16 Claims, 7 Drawing Figures

SAFETY COVER FOR AN ELECTRICAL OUTLET

BACKGROUND OF THE INVENTION

1. Field of the Invention

The safety cover has universal application wherever an electrical outlet is provided such as in houses, buildings, schools, churches, etc. Such outlets may, as an example, be floor or wall mounted. Regardless of the location of the outlet, it presents a danger to babies and children of tender years who may touch the outlet.

2. Description of the Prior Art

Relatively large closure plugs with prongs have been used in the past to cover electrical outlets and to prevent children from touching the electrical sockets. However such closure plugs are removed from the sockets when it is necessary to connect an electrical cord thereto. Thus babies and small children are still exposed to danger when the closure plugs are removed.

SUMMARY OF THE INVENTION

It is a feature of the present invention to provide a safety cover for an electrical outlet which encloses the sockets of the outlet regardless of whether or not any electrical plugs are inserted therein to prevent infants and children of tender years from touching or contacting the electrical sockets. With such a construction one or more releasably mounted hollow closure elements are employed which overlie and enclose the plugs and sockets thus positively preventing an infant from being hurt, shocked or injured by shielding the electrical source.

It is a further feature of the present invention to provide a safety cover of the aforementioned type wherein the closure elements are hingedly mounted on the plate which surrounds the electrical outlet.

A still further feature of the present invention is to provide a safety cover of the aforementioned type wherein the plate is provided with a pair of latching elements which engage portions of the closure elements to enclosure the sockets and plugs and to maintain the closure elements in a latched position which cannot be released by infants or small children.

Another feature of the present invention is to provide a safety cover of the aforementioned type wherein the electrical cords extend through small slots provided in the closure elements.

Still another feature of the present invention is to provide a safety cover of the aforementioned type wherein each of the closure elements is flexible and can be squeezed or urged together by adults or older children to release the latched position, thus exposing the plugs and sockets.

A further feature of the present invention is to provide a safety cover of the aforementioned type wherein the plate and closure elements are made from a plastic material, with the closure elements being provided with integral hinges for connecting the closure elements to the back side of the plate.

Another feature is to provide a safety cover which is safe, simple in construction, economical to manufacture, easy to assemble and install, and which can be operated by adults but not by infants and small children.

DESCRIPTION OF A PREFERRED EMBODIMENT

The safety cover is designated by the numeral 10 and includes a plate 12 and a pair of hollow closure elements 14 of identical configuration.

Figure 4:
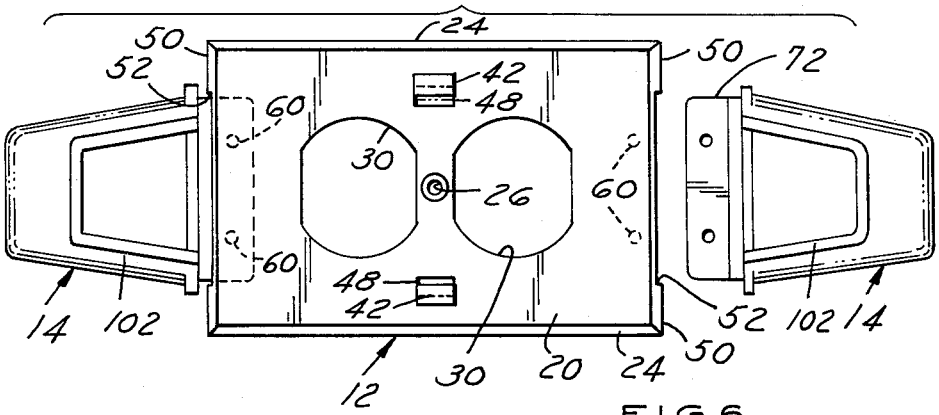
FIG. 4 is a front view of the safety cover including the plate with one of the closure elements detached from the plate.
Figure 5:
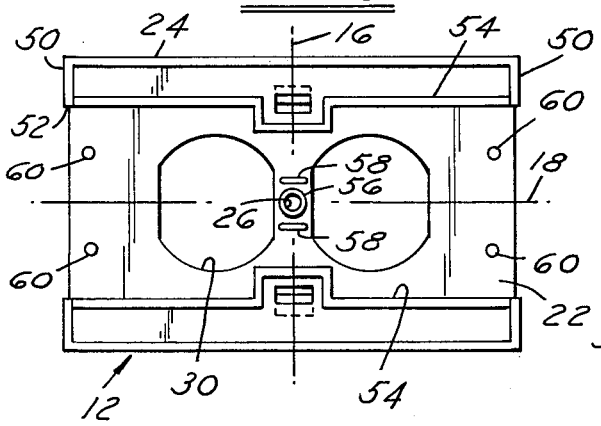
FIG. 5 is a rear view of the plate.
Figure 6:
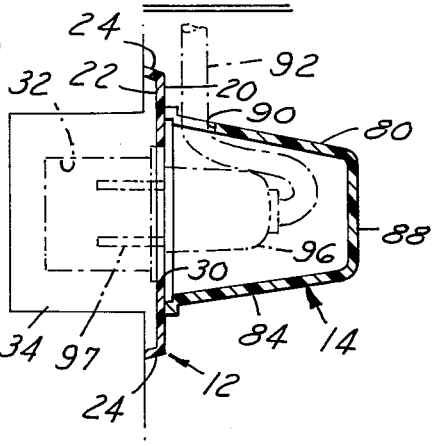
FIG. 6 is a sectional view through the safety cover taken on the line 6—6 of FIG. 2 and showing a wall mounted electrical outlet and plug enclosed by the safety cover.

The plate 12 is of rectangular configuration (FIGS. 4 and 5) and has a pair of axes 16 and 18 intersecting at the center thereof as shown in FIG. 5. Plate 12 has a front surface 20 and a back surface 22 and includes a pair of longitudinally extending edges parallel to axis 18 and a pair of transversely extending edges parallel to axis 16. The longitudinal edges are provided with a slight tapered surface 24 (FIG. 6). Extending through the center of the plate 12 is a bolt opening 26 located in a bridge portion 28 of the plate 12. A pair of identical openings 30 are provided in the plate 12 on opposite sides of the bridge 28 for exposing the sockets 32 of an electrical outlet 34. The socket openings 30 extend through the front and back surfaces 20, 22 of plate 12.

In use, the conventional plate for the electrical outlet 34 is removed and the plate 12 is substituted therefor to cover the outlet. A threaded fastener 36 (FIG. 7) is inserted into plate opening 26 and is threaded into the existing female part 38 of the electrical outlet 34 so as to secure the plate 12 against the wall 40. It should be appreciated however that the safety cover 10 can be used with any type of electrical receptacle regardless of whether it is mounted in the floor or wall, etc., as mentioned previously.

The front surface 20 of plate 12 is provided with a pair of integral latching elements 42 located near the longitudinal edges of plate 12 and spaced apart along the axis 16 as shown in FIGS. 4 and 5. Each latching element 42 has a pair of retaining or latching surfaces 44, 46, with retaining surfaces 46 being spaced from and parallel to the front surface 20 to form with the surface 44 a retaining slot or groove. An opening 48 is provided in plate 12 behind each latching element 42 at the time the plate 12 is molded or formed.

As shown in FIG. 4, the tapered surface 24 is provided on the longitudinal edges thereof. The transverse or side edges also have tapered surfaces 50 (FIG. 4), each of which are cut away or formed with an elongated hinge slot 52 (FIG. 4) which is used for a purpose to be subsequently explained.

The back or rear side 22 of plate 12 (FIG. 5) includes a pair of reinforcing ribs 54 which connect the tapered side surfaces 50. The opening 26 in plate 12 terminate on the back surface thereof in a cylindrical collar 56 provided on opposite sides thereof with spacing elements 58 which engage the electrical outlet.

Fastening means are provided on the back surface 22 along each transversely extending edge of plate 12 and take the form of a pair of integral cylindrical pins 60. Each pair of pins 60 are spaced on opposite sides of axis 18 and are located or set inwardly from the corresponding slot or edge 52 as shown in FIGS. 4 and 5.

Each hollow closure element 14 has an integral base or frame 64 and a cup-like container 66 in the form of a frustum of a pyramid. The frame 64 includes elongated spaced apart parallel abutments or ribs 68 which are connected at one side by frame part 70. An extension member or element 72, having a length corresponding to the height of plate slot 52, is connected to frame part 70 by a relatively thin flexible hinge 74 which has a length equal to the length of the extension element 72. Thus extension member 72 is hingedly mounted on frame 64 like a door mounted in a door frame. The extension element 72 is formed with a pair of small openings 76 which are spaced apart the same distance as the pins 60.

Figure 2:
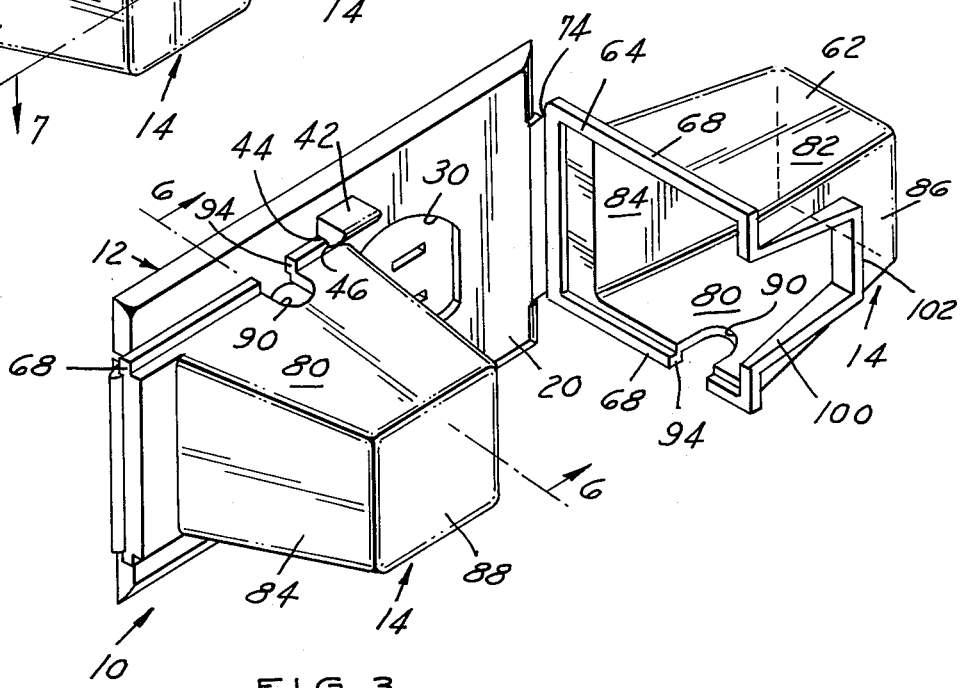
FIG. 2 is a perspective view of the safety cover showing one closure element latched and the other closure element unlatched.
Figure 3:
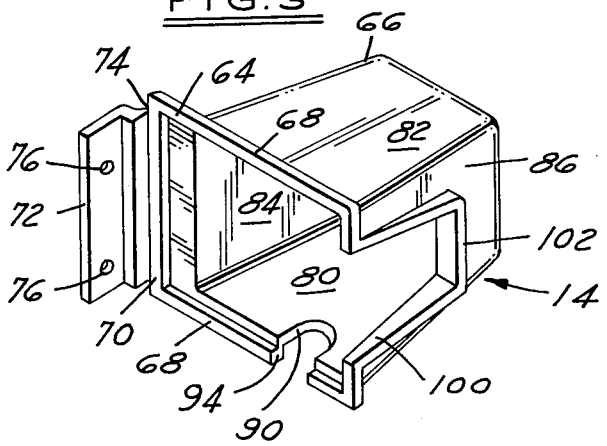
FIG. 3 is a perspective view of a closure element.

The cup-shaped formation 66 made in the form of a frustum of a pyramid is opened at the plate engaging surface of frame 64 as shown in FIGS. 2 and 3 and includes four tapered sides 80, 82, 84 and 86 and a top 88.

A slot 90 for an electrical cord 92 is provided in side 80. The sot 90 has a slot extension 94 in the abutment or rib 68 of frame 68 (FIGS. 2 and 3). The cords 92 each has a plug 96 with prongs 97 which fit into the corresponding electrical socket 32 (FIG. 6).

Figure 7:
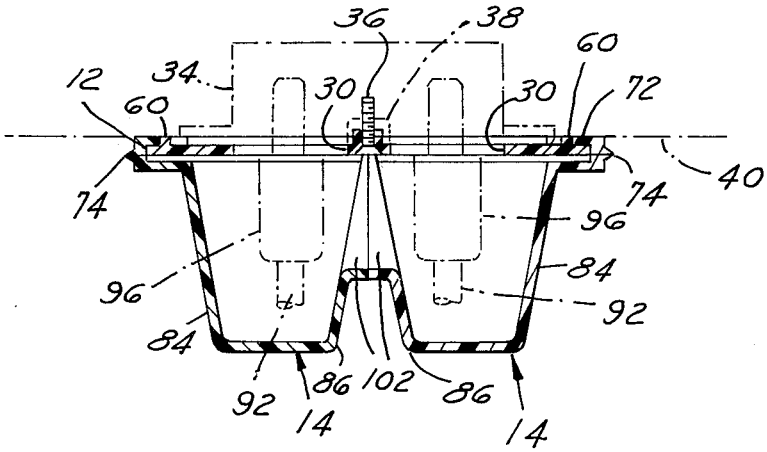
FIG. 7 is a sectional view taken on the line of 7—7 of FIG. 1 and showing the safety cover in a latched position enclosing the electrical sockets and plugs.

Side wall 86 is provided with a relatively large opening 100 which is reinforced by a tapered frame 102 as shown in FIGS. 2 and 3. The outer surfaces of tapered frame 102 lie in a plane which is perpendicular to the plate 12. Such surfaces abut when assembled as shown in FIG. 7 thus closing the openings 100.

In use, the conventional wall plate, not shown, is removed. The two closure elements 14 are hingedly mounted on plate 12. The cup-shaped formations 66 overlie the front of plate 12. The hinge 74 of the extension element 72 of each closure element 14 is wrapped around the corresponding edge or slot 52. As a result thereof, the extension elements 72 engage the back surface 22 of plate 12 and are removably connected thereto by the interengagement between the mounting pins 60 and openings 76 provided in extension elements 72. The extension elements 72 abut the plate 12 (FIG. 7) and are held against the wall 40 by the bolt 35 described previously. Thereafter, the closure elements 14 which are hingedly mounted by the flexible hinges 74, can be opened or closed.

Figure 1:
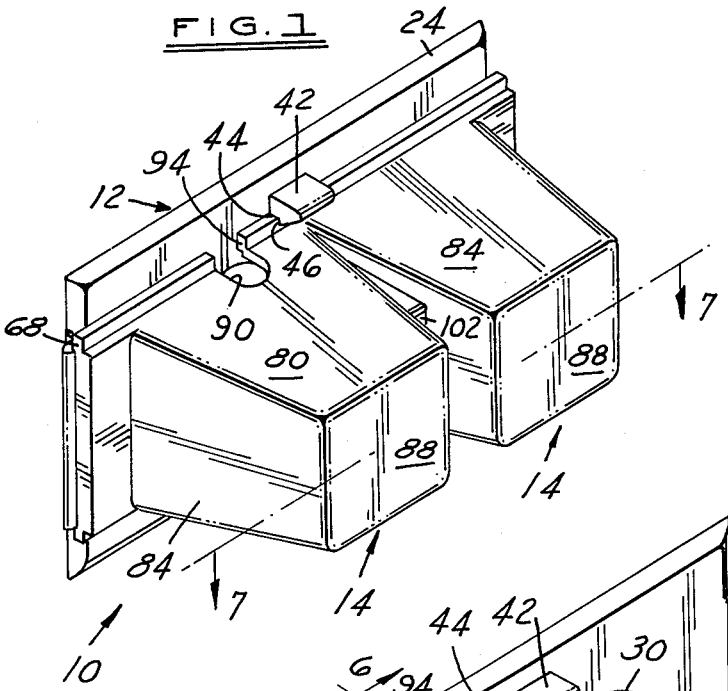
FIG. 1 is a perspective view of the safety cover including the plate and closure elements in a latched position.

When the closure elements 14 are opened, one or a pair of plugs 96 of electrical cords 92 are inserted in the sockets 32. Thereafter, the closure elements 14 are closed and latched, with the corresponding abutments 68 being moved or flexed toward each other and thereafter released to fit in the space or groove defined by the latching elements 42 and retaining surfaces 44, 46 as shown in FIGS. 1 and 2. The cords 92 extend through the slots 90, 94 and the plugs 96 and sockets 32 are completely enclosed by the safety cover 10 (FIGS. 6 and 7). An adult can open the closure elements 14 by squeezing or flexing the surfaces or sides 80 and 82 adjacent the ends of the ribs 68 to unlatch or release the abutments from the latching elements 42.

The plate 12 and closure elements 14 are made from a resilient plastic material by a conventional molding operation. The various slots, openings, ribs, hinges, etc., are formed during the molding operation. Both closure elements are made from the same mold.

The large opening 100 provided in wall or side 86 of each closure element provides for flexibility so that the abutments 68 adjacent opening 100 may be moved towards one another.

What is claimed is:

1. A safety cover for an electrical outlet having at least one electrical socket for receiving the plug end of an electrical cord, said cover comprising a plate adapted to be mounted against the electrical outlet, said plate having a front surface, a back surface and an opening extending through said surfaces for exposing the socket, the front surface of said plate having a pair of spaced apart latching elements, and a hollow closure element connected to said plate and extending across the front surface of said plate and the exposed socket, said closure element having thereon a pair of spaced apart abutments engageable with said latching elements for securing said closure element on said plate and thereby enclosing the socket, said closure element being provided at one edge thereof with an integral flexible hinge which includes an extension engageable with the back surface of said plate, said extension and said plate including means for removably connecting said closure element at the back surface of said plate.

2. The safety cover of claim 1 wherein said latching elements are integral with said plate and include retaining surfaces extending from the front surface of said plate, the abutments on said closure element being received between said retaining surfaces and the front surface of said plate.

3. The safety cover of claim 2 wherein said plate and said closure element are made from a plastic material, said closure element being flexible to permit said abutments to be moved relative to one another to latch and unlatch said abutments with respect to said latching elements.

4. The safety cover of claim 3 wherein said closure element includes a wall portion having an opening between said abutments which permit the abutments to be moved relative to one another.

5. The safety cover of claim 1 wherein said closure element includes a wall portion adjacent said plate which is provided with a slot for receiving an electrical cord.

6. The safety cover of claim 1 wherein said closure element is hingedly connected to said plate.

7. The safety cover of claim 1 wherein said plate is of rectangular configuration and includes a pair of longitudinally extending edges of a pair of transversely extending edges, with said latching elements being located near said longitudinally extending edges at one side of the opening therein, said means including a pair of integral fastening elements at the back side of said plate along one of said transversely extending edges, said flexible hinge being engageable with said one transversely extending edge, with said extension having openings which removably receive said fastening elements for connecting said closure element at the back surface of said plate.

8. A safety cover for an electrical outlet having a pair of electrical sockets for receiving the plug ends of electrical cords, said cover comprising a plate adapted to be mounted against the elctrical outlet, said plate having a front surface, a back surface and a pair of openings extending through said surfaces for exposing the sockets, the front surface of said plate having a pair of spaced apart latching elements, and a pair of hollow closure elements, said closure elements being connected to said plate and extending across adjacent portions of the front surface of the plate and the exposed sockets, each of the closure elements having thereon a pair of spaced apart abutments engageable with said latching elements for securing the closure element on said plate and thereby enclosing the corresponding socket, each of said closure elements being provided at one edge thereof with an integral flexible hinge which includes an extension engageable with the back surface of said plate, said extension and said plate including means for removably connecting the corresponding closure element at the back surface of said plate.

9. The safety cover of claim 8 wherein said latching elements are integral with said plate and include retaining surfaces extending from the front surface of said plate, the abutments on each of said closure elements being received between said retaining surfaces and the front surface of the said plate.

10. The safety cover of claim 9 wherein said plate and said closure elements are made from a plastic material, said closure elements being flexible to permit said abutments on each of the closure elements to be moved relative to one another to latch and unlatch the corresponding abutments with respect to said latching elements.

11. The safety cover of claim 10 wherein each of said closure elements includes a wall portion having an opening between the abutments which permit the abutments to be moved relative to one another.

12. The safety cover of claim 11 wherein the wall portions of said closure elements, with the openings therein, are positioned to abut one another to close said openings from view when said closure elements are latched on said plate.

13. The safety cover of claim 8 wherein each of said closure elements includes a wall portion adjacent said plate which is provided with a slot for receiving and electrical cord.

14. The safety cover of claim 8 wherein said closure elements are hingedly connected to said plate.

15. The safety cover of claim 8 wherein said plate is of rectangular configuration and includes a pair of longitudinally extending edges and a pair of transversely extending edges, with said latching elements being located near said longitudinally extending edges between the openings therein, said means including a pair of integral fastening elements at the back side of said plate along each of said transversely extending edges, said flexible hinge of each closure element being engageable with a transversely extending edge and with the corresponding extension having openings which removably receive said fastening elements for connecting the corresponding closure element at the back surface of said plate.

16. The safety cover of claim 8 wherein each closure element is in the form of a frustum of a pyramid.

* * * * *